United States Patent [19]

Dikoff

[11] Patent Number: 4,535,987

[45] Date of Patent: Aug. 20, 1985

[54] GOLF TOOL

[76] Inventor: Joseph K. Dikoff, P.O. Box 4553, Christiansted, St. Croix, V.I. 00820

[21] Appl. No.: 643,154

[22] Filed: Aug. 22, 1984

[51] Int. Cl.[3] ..... A63B 57/00

[52] U.S. Cl. ..... 273/32 B; 116/225; 273/DIG. 26; 273/32 A; 7/138; 7/152; 7/164

[58] Field of Search ..... 273/32 B, 32 A, 32 R, 273/162 A, 162 D, 162 F, DIG. 26; 116/222, 223, 224, 225; 7/151; 81/3.1 R, 3.34, 3.35

[56] References Cited

U.S. PATENT DOCUMENTS

| | | | |
|---|---|---|---|
| 1,775,066 | 9/1930 | Bulova | 116/223 |
| 3,049,182 | 8/1962 | Pelow | 273/32 B |
| 3,203,700 | 8/1965 | Antonious | 273/32 B X |
| 3,744,542 | 7/1973 | Stephens | 273/32 B X |
| 3,763,515 | 10/1973 | Voss | 273/32 B X |
| 3,774,913 | 11/1973 | Dien | 273/32 A X |
| 4,133,228 | 1/1979 | DePooter | 81/3.1 R |
| 4,315,624 | 2/1982 | Buckman | 273/32 B X |

*Primary Examiner*—William H. Grieb
*Attorney, Agent, or Firm*—Bruce L. Birchard

[57] ABSTRACT

A multi-purpose golf tool which provides, on a single, collapsible, compact carrier, most of the functions required by a golfer in the course of a round of golf, the carrier, itself, being constructed to perform certain of the functions in addition to acting as the carrier for the other elements of the tool.

1 Claim, 5 Drawing Figures

GOLF TOOL

BACKGROUND OF THE INVENTION

1. Field of the Invention

This invention relates to tools useful in the playing of the game of golf and more particularly to a multi-purpose, compact tool in which the elements of the tool perform, in combination with the other elements of the tool, multiple functions.

2. Prior Art

For persons who play golf, a single round of golf may require that multiple tasks be performed, besides the task of driving the golf ball into the cup at each hole. For example, in the course of hitting a golf ball off the grass on the fairway, it is not uncommon to gouge the earth so as to bring forth a divot. It is a necessity and a common courtesy for the golf player to replace the divot so that the next player is not disadvantaged by the hole left in the surface of the grass by his errant golf club. Similarly, it is common for mud to become lodged in the grooves in the face of the golf club head. Such mud changes the performance of the club and it is sometimes necessary to take a sharp tool or a rounded tool to remove the mud. As is well-known, the shoes worn by a golfer have cleats in the soles thereof to prevent loss of footing during the driving of a golf ball. These cleats become damaged, as by walking on concrete sidewalks. When they are damaged they must be removed and replaced. Usually a separate tool is provided for this purpose. Of course, an important part of the golf game is recording the score on each hole. Ofttimes it is difficult to recall the number of strokes taken on any one hole. The honest golfer, of which there are a few, requires an aid to record each of the strokes so that at the end of the battle to the cup on each hold he has an accurate recollection of how many strokes he has taken. A separate stroke-counter sometimes is provided for this purpose. It is also true that in the course of playing the game he wishes to record the strokes indicated by the stroke-counter and the normal practice is to carry a short pencil and a scorecard. Such pencil often becomes dull or broken and must be sharpened in the course of the golf round. A golfer may carry a knife for this purpose.

When the golfer is playing in a group it is not uncommon to have several balls on a green at the same time with some of the balls obstructing the line of travel of the other balls from their location into the sometimes elusive cup. It is conventional, therefore, to lift the ball which is in the line of travel of another ball, replacing the obstructing ball with a coin or other relatively flat object which will permit the passage of the more remote ball to the cup without deviation of any consequence. This means that the golfer should carry change with him while making the golf round. On some days he may forget to carry such change.

On a hot and sunny day it is not uncommon for a golfer to secret in his golf bag a capped bottle of some refreshing liquid. It is, of course, necessary to remove the cap from such a bottle in order to enjoy its contents. The practice of removing the cap of a bottle with one's teeth can prove very expensive and, also, not too socially acceptable. Thus it is the practice of some golfers to carry, along with all the other gadgets which they must carry, a bottle-opener.

It is apparent from the foregoing discussion that, before a golfer can, with confidence, head out onto the long and winding golfcourse he must, with matters as they were prior to my invention, have a clear head and a list of tools and implements needed to complete the day's journey. That, of course, in addition to the usual complement of golf clubs, gloves and balls.

Therefore, it is a general object of this invention to provide a compact, multi-purpose golf tool which overcomes the general disadvantages of prior art devices.

It is a further object of this invention to provide a compact, collapsible multi-purpose golf tool in which the various elements cooperate with each other to permit the performance of substantially all of the support functions required by the golfer in the course of completing a round of golf.

SUMMARY OF THE INVENTION

A compact, collapsible carrier has, in itself, a plurality of elements each of which can perform several of the functions required by the golfer, for example, cleat removal, groove cleaning, divot mending, pencil sharpening and bottle opening. For example the element which carries the bottle opener, a cleat remover and a stroke-counter acts as the handle for the element which acts as the divot mender and the pencil sharpener. Furthermore, that element which is acting as a handle also acts as the carrier for a snap-on ball-marker. By pivotal interconnection between elements the tool may be collapsed into minimum size for easy carrying by the golfer.

BRIEF DESCRIPTION OF THE DRAWINGS

Features of the present invention which are believed to be novel are set forth with particularity in the appended claims. The present invention, both as to its organization and manner of operation, together with further objects and advantages thereof, may be best understood by a reference to the following description taken in connection with the accompanying drawings, in which:

DETAILED DESCRIPTION OF THE PREFERRED EMBODIMENT

Figure 1:
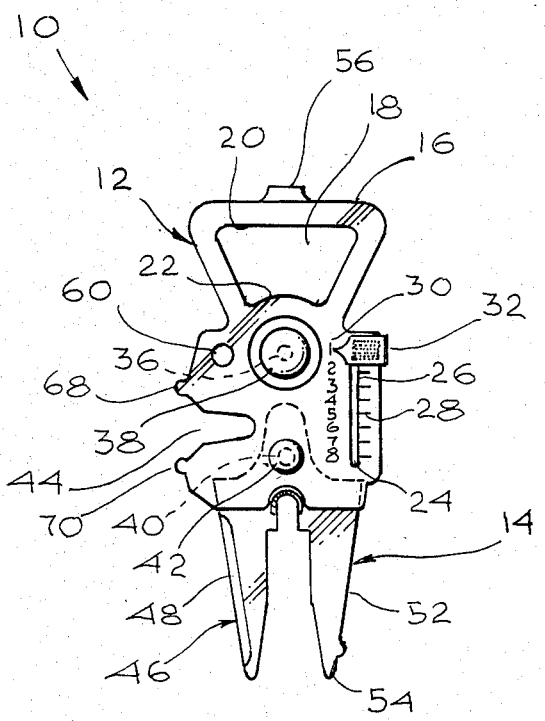
FIG. 1 is a front, elevational view of a golf tool according to my invention.

In FIG. 1 golf tool 10 has a main carrier element or body 12 and an ancillary carrier element or body 14, the combination of the main body 12 and the ancillary body 14 constituting a base member of tool 10. The opener end 16 of main body 12 has a trapezoidally shaped opening 18 therein sized such that edge 20, thereof, when engaging the lower edge of the cap on a bottle will result in edge 22, which can be seen to be of shorter length, resting on the upper surface of the cap towards the opposite edge thereof from that which is engaged by edge 20. Main body portion 12 has a further slot-like opening 24 therein along one edge 26 of which there is a series of graduations 28 with appropriate markings 30, for example numbers 1 through 8. Adapted for sliding in slot 24 is a cursor 32 which is of resilient material, such as plastic, and is retained in slot 24 by its resilient forces along with certain guide elements 34 which may be seen more clearly in FIG. 5.

Main body 12 also has an opening 36, therein, to receive, in snap-in fashion a ball-marker 38. The mechanism for retaining ball-marker 38 in opening 36 is similar to that used in a collar snap or in other snap connectors. The details of such snap connector need not be described here.

Figure 2:
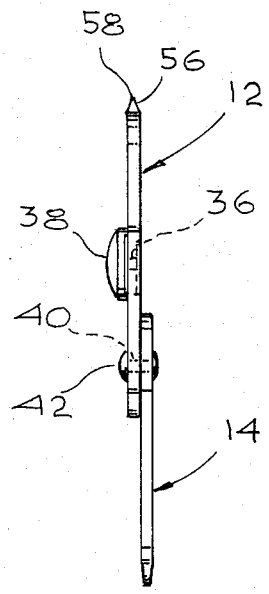
FIG. 2 is a side elevational view of the golf tool of FIG. 1.

Main body 12 includes another opening 40, which can be seen more clearly in FIG. 2, for receiving a rivet 42. The purpose of rivet 42 being to join ancillary body 14 to main body 12, as can be seen more clearly in FIG. 2.

Recess 44 in main carrier element or body 12 is sized and shaped to engage a cleat in the sole of the golfer's shoe for easy removal of the cleat when it is defective.

Leg 46 of ancillary carrier element or body 14 may be sloped in region 48 to form a knife edge. This knife can be used to sharpen the golfer's pencil. It should be noted that ancillary carrier element 14, as can be seen more clearly in FIG. 3, has an opening 50 therein to receive rivet 42 which pivotally interconnects main carrier element 12 and ancillary carrier element 14.

Leg 52 of ancillary carrier element 14 may have a sharp tip 54 which may be used for cleaning grooves in golf-club-head-faces. Leg 52 may also be used to firmly replace divots that have been removed. As can be seen in FIG. 2, protuberance 56 at the upper extremity of main carrier element 12 may be tapered at 58 to form protuberance 56 into a screwdriver-like tip.

Figure 3:
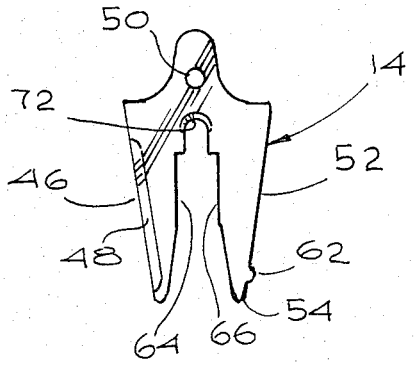
FIG. 3 is a front elevational view of a portion of the tool of FIG. 1.
Figure 4:
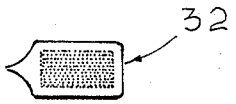
FIG. 4 is a front elevational view of another portion of the golf tool according to my invention; and, FIG. 5 is an edge elevational view of the element of FIG. 4.

As in evident from the FIGS. 1, 2 and 3, main carrier element 12 may be rotated about rivet 42, which acts as a pivot, and the overall length of tool 10 in this folded condition, can be reduced to about one-half the length of the tool when it is opened for use.

Opening 60 is provided in main carrier element 12 to permit connection of tool 10 to a key-chain.

Look briefly at FIG. 3, in addition to sharpened end 54 on leg 52, protuberance 62 is provided for the purpose of cleaning any rounded grooves in the golf club heads. Further, edges 64 and 66 are spaced so as to engage the flats of a quarter inch nut.

In FIG. 1 protuberances 68 and 70 are sized and spaced to engage corresponding recesses in the cleats utilized on the soles of golfers' shoes.

Figure 5:
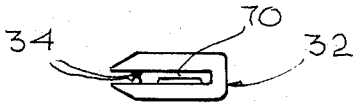

In FIG. 5, slide 70 prevents binding of indicator 32 as it is slid along slot 24.

In FIG. 3, edges 64 and 66 have been described as being spaced so as to engage the faces of a quarter inch bolt. Recess 72 has sharpened edges so as to permit cutting of tees to a desired size.

While a particular embodiment of this invention has been shown and described, it will be apparent to those skilled in the art that variations and modifications may be made therein without departing from the spirit and scope of this invention. It is the purpose of the appended claims to cover all such variations and modifications.

I claim:

1. A golf tool including:

a main carrier element;

an ancillary carrier element pivotably connected by a first pivot to said main carrier element;

said ancillary carrier element having a pair of tapered leg portions each terminating, at its end remote from said first pivot, in a narrowed region and each having increasing spacing from the other as each of said narrowed regions is approached;

one of said leg portions carrying pointed means for cleaning the faces of golf club heads;

said main carrier element carrying along its periphery a protuberance having a screwdriver-like tip;

said main carrier element including, in addition, a region having a trapezoidally shaped opening therein sized to engage and remove caps from bottles; and, mechanical snap means carried by said main carrier element for mechanically and releasably holding a ball marker;

said main carrier element having along the periphery thereof, in addition to said protuberance having a screwdriver-like tip, means for coupling to golf-shoe cleats for the removal of such cleats from golf shoes.

* * * * *